US005904102A

United States Patent [19]

Brinkmann et al.

[11] Patent Number: 5,904,102

[45] Date of Patent: May 18, 1999

[54] DRIVEN LOOSE WHEEL AXLE

[75] Inventors: Andreas Brinkmann, Remscheid; Thaddäus Kasprzyk, Mülheim, both of Germany

[73] Assignee: Gütehoffnungshütte Radsatz GmbH, Oberhausen, Germany

[21] Appl. No.: 08/984,264

[22] Filed: Dec. 3, 1997

[30] Foreign Application Priority Data

Dec. 7, 1996 [DE] Germany ..... 196 50 913

[51] Int. Cl.[6] ..... B61C 9/00

[52] U.S. Cl. ..... 105/96

[58] Field of Search ..... 105/96, 97, 108, 105/132; 295/44

[56] References Cited

U.S. PATENT DOCUMENTS

| | | | |
|---|---|---|---|
| 1,567,972 | 12/1925 | Meehan | 105/97 |
| 4,170,945 | 10/1979 | Kayserling | 105/132 |

FOREIGN PATENT DOCUMENTS

| | | |
|---|---|---|
| 32 30 453 A1 | 2/1984 | Germany . |
| 37 32 337 C2 | 11/1990 | Germany . |
| 40 40 303 A1 | 6/1992 | Germany . |
| 42 34 831 C1 | 1/1994 | Germany . |
| 93 19 845 U1 | 4/1994 | Germany . |
| 44 29 889 A1 | 2/1996 | Germany . |
| 196 00 420 C1 | 2/1997 | Germany . |

OTHER PUBLICATIONS

Jan./Feb. 1991, ZEV+DET Glas. Ann. 115.

1996, Combino, die modulierbare . . . , Verkehr und Technik.

1994, Neues bei Laufwerkskompone nten und . . . , Der Nahverkehr.

*Primary Examiner*—S. Joseph Morano

*Attorney, Agent, or Firm*—McGlew and Tuttle, P.C.

[57] ABSTRACT

The present invention pertains to a driven loose wheel axle with individually mounted wheels for single-axle or double-axle chassis for rail-borne vehicles, especially for chassis or bogies on low-platform vehicles, wherein a drive is fastened to the chassis frame on the outside on each longitudinal side of the chassis and the drive is connected to the corresponding loose wheel via a cardanic double coupling. According to the present invention, a wheel-carrying frame (1) with contact surfaces (14) for the primary spring system surrounds the two wheels (2) from the outside; the driven interface (3) of the cardanic double coupling is arranged on the inner side of the wheel and the drive interface of the cardanic double coupling is arranged outside the wheel-carrying frame. The cardan shaft (5) provides a connection between the drive interface and the driven interface (3) and is led through a central opening of the wheel (2) and of the wheel-carrying frame (1).

12 Claims, 3 Drawing Sheets

DRIVEN LOOSE WHEEL AXLE

FIELD OF THE INVENTION

The present invention pertains to a driven loose wheel axle with individually mounted wheels for single-axle or double-axle chassis for rail-borne vehicles, especially for chassis or bogies on low-platform vehicles, wherein a drive is fastened to the chassis frame on the outside on each longitudinal side of the vehicle, and the drive is connected to the corresponding loose wheel via a cardanic double coupling.

BACKGROUND OF THE INVENTION

Nondriven, braked carrying chassis (individual or double-axle carrying chassis), which use so-called loose wheel axles to allow a low floor even in the area of the chassis, have been known from FIGS. 6 and 8 of the article "Neues bei Laufwerkskomponenten und gummigefederten Rädern" [New Developments in Chassis Components and Rubber-sprung Chassis] published in the journal *Der Nahverkehr*, No. 6/94. The loose wheel axle comprises essentially a nonrotating axle (portal axle) bent at right angles with bilateral axle heads with axle stubs, on which a usually rubber-sprung loose wheel each is mounted. The chassis frame of the chassis is supported on the loose wheel axle via a primary spring system. For example, the loose wheel axle for the standard gauge has for this purpose two machined contact surfaces for the primary spring system at the axle head on the inner side of the wheel. Even though the loose wheel axles of the above-mentioned designs are equipped with a disk brake, they have no possibility for driving.

Driven loose wheel axles of this type on a double-axle chassis for rail-borne vehicles have been known from DE 44 29 889 A1. A practical embodiment for this is shown, e.g., in the article "Combino, die modulierbare Niederflurstraβenbahn . . . " [Combino, the Low-Platform Street Car that Can be Modulated] published in the journal *Verkehr und Technik*, No. 9/96, pp. 387 ff. A chassis frame is supported here on two loose wheel axles (portal axles) bent at right angles, wherein the primary spring system connecting the contact surfaces for the chassis and axles is located on the inside of the wheels.

The drive to transmit the torque of the loose wheels of the loose wheel axles takes place in the form that a cardanic double coupling, which acts on the outer side of the wheel, is arranged between the primarily sprung, electromechanical drive arranged on the outer side of the vehicle and the corresponding loose wheel.

The design of the loose wheel axles with cardanic double coupling acting on the wheel and connections located on the inside for the primary spring system usually makes it possible, e.g., in the case of standard-gauge vehicles (gauge about 1,435 mm) to arrange a low-platform central aisle between the heads of the loose wheel axle with a sufficient width.

The width of the central aisle of the low-platform car is additionally further limited in an undesired manner due to the arrangement of the contact surfaces for the primary spring system on the inner side of the wheel in the case of vehicles with narrower gauge (e.g., for narrow-gauge railways with a gauge of 1,000 mm), in which the distance between the inner surfaces of the wheels is shorter. This also applies to, e.g., standard-gauge vehicles in which a greater central aisle width is desired than is made possible by the above-mentioned solution.

SUMMARY AND OBJECTS OF THE INVENTION

The primary object of the present invention is therefore to propose a driven loose wheel axle, in which this problem does not exist and, in addition, an excessively great overall width of the loose wheel axle and drive is avoided in order to also make possible, e.g., narrow-gauge vehicles with simultaneously small car body width without a disturbing projection of the chassis.

According to the invention, a driven loose wheel axle with individually mounted wheels for single-axle or double-axle chassis for rail-borne vehicles is provided. The arrangement is especially for chassis or bogies on low-platform vehicles. A drive is fastened to the chassis frame on the outside on each longitudinal side of the vehicle, and the drive is connected to the corresponding loose wheel via a cardanic double coupling. The wheel-carrying frame is provided with contact surfaces for the primary spring system. The wheel-carrying frame surrounds the two wheels from the outside. A driven plane (interface) of the cardanic double coupling is arranged on the inner side of the wheel. The drive plane (interface) of the cardanic double coupling is arranged outside the said wheel-carrying frame. The cardan shaft is led, as a connection between the said drive plane and the said driven plane, through a central opening of the wheel and of the said wheel-carrying frame.

The wheel may be mounted on the inner side of the wheel-carrying frame on a hollow axle stub directly or by means of a flange connection. The wheel disk is part of the driven plane (interface) of the cardanic double coupling.

A ground contact may be integrated within the cardan shaft. The ground contact may be connected to the wheel-carrying frame via a torque support. Current bridges may then lead from the cardan shaft-side coupling molette of the driven plane to the wheel tire. Current insulation is ensured via the rubber elements of the driven plane and the rubber ring of the wheel.

The present invention is essentially based on the arrangement of the contact surfaces for the primary spring system and of the drive plane of the cardanic double coupling being transposed in relation to the wheel, so that the contact surfaces are arranged on the outer side of the wheel, and the driven plane of the coupling is arranged on the inner side of the wheel. This requires that the portal axle bent at right angles be led around both wheels in a U-shaped pattern, with the primary spring contact surfaces being provided on the two legs. The connection between the drive plane and the driven plane of the cardanic double coupling, which connection is designed as a cardan shaft, is led through a central opening of the wheel and of the wheel-carrying frame.

Since the mounting width for the driven plane of the cardanic double coupling is now substantially smaller compared with, e.g., the arrangement described in DE 44 29 889 A1 than that for the axle head of the wheel-carrying frame (contact surfaces for the primary spring system), the vehicle floor can be widened as a result, or it thus becomes meaningfully possible only in narrow-gauge vehicles.

It has proved to be favorable for the wheel to be mounted on the inner side of the wheel-carrying frame on the shortest possible hollow axle stub as a wheel carrier and for this wheel carrier to be connected to the wheel-carrying frame either directly or by means of a flange connection. A stable construction with small overall width is achieved as a result. The overall width is additionally reduced if the wheel disk is part of the driven plane of the cardanic double coupling.

A grounding contact of a prior-art design may be provided per wheel. The special features is now that the rotating component of the contact is directly integrated within the cardan shaft, while the nonrotating component is connected to the wheel-carrying frame via a torque support, which is, e.g., also used as the electric lead at the same time. To send current to the wheel tire, current bridges are present between the wheel tire and the coupling molette provided at the cardan shaft on the driven side. Since the cardan drum is isolated against the wheel disk via the rubber assemblies of the driven plane of the cardanic double coupling, and the wheel disk is also isolated against the wheel tire by the rubber ring of the rubber-sprung wheel, the use of expensive, current-insulated wheel bearings may be abandoned. Flow of current through the rolling bearings is avoided by the design described.

Besides the chassis design described in DE 44 29 889 A1 with two loose wheel axles (double-axle chassis) and coupling of the wheels of one longitudinal side by a longitudinally arranged motor with two flanged bevel gear pairs, embodiments in which the longitudinal coupling is performed by a transversely arranged motor and a spur gear mechanism connecting the motor and the two loose wheels are possible as well. Single-axle chassis are also conceivable, in which there obviously is no longitudinal coupling, because only one loose wheel is connected to a drive (motor or motor-gear unit) per side.

How the drive torque is generated on the drive side of the cardanic double coupling and whether the loose wheel axle is used in a single-axle chassis or in a double-axle chassis are therefore irrelevant for the driven loose wheel axle that is the subject of the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
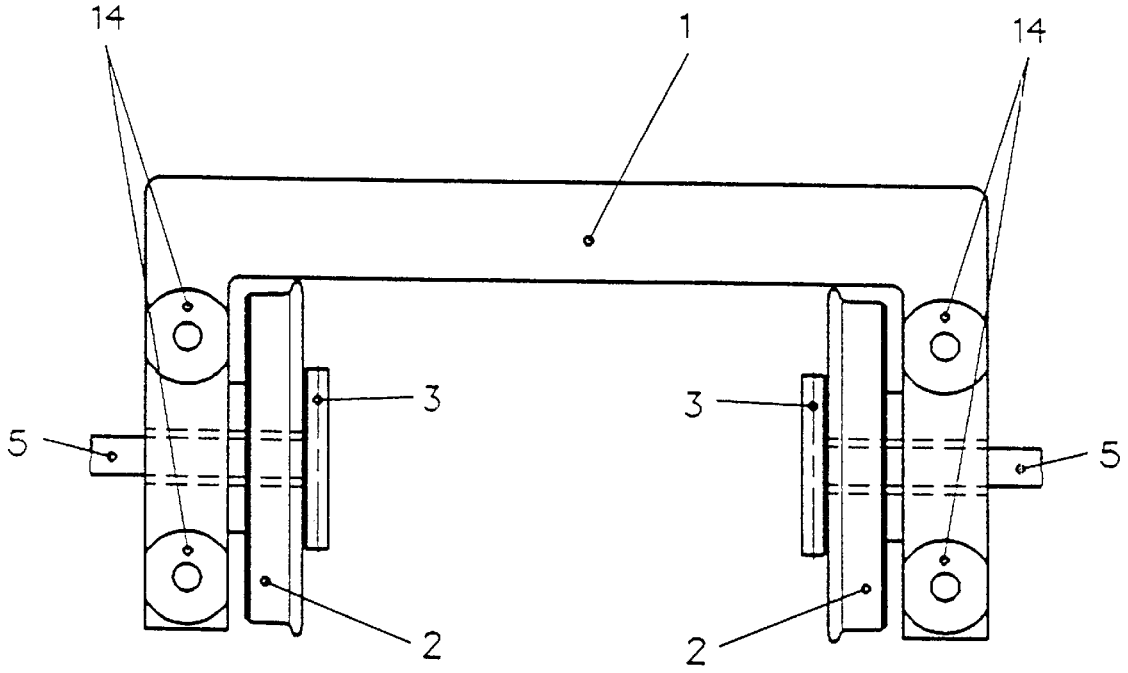
FIG. 1 is a top view of the driven loose wheel axle.
Figure 2:
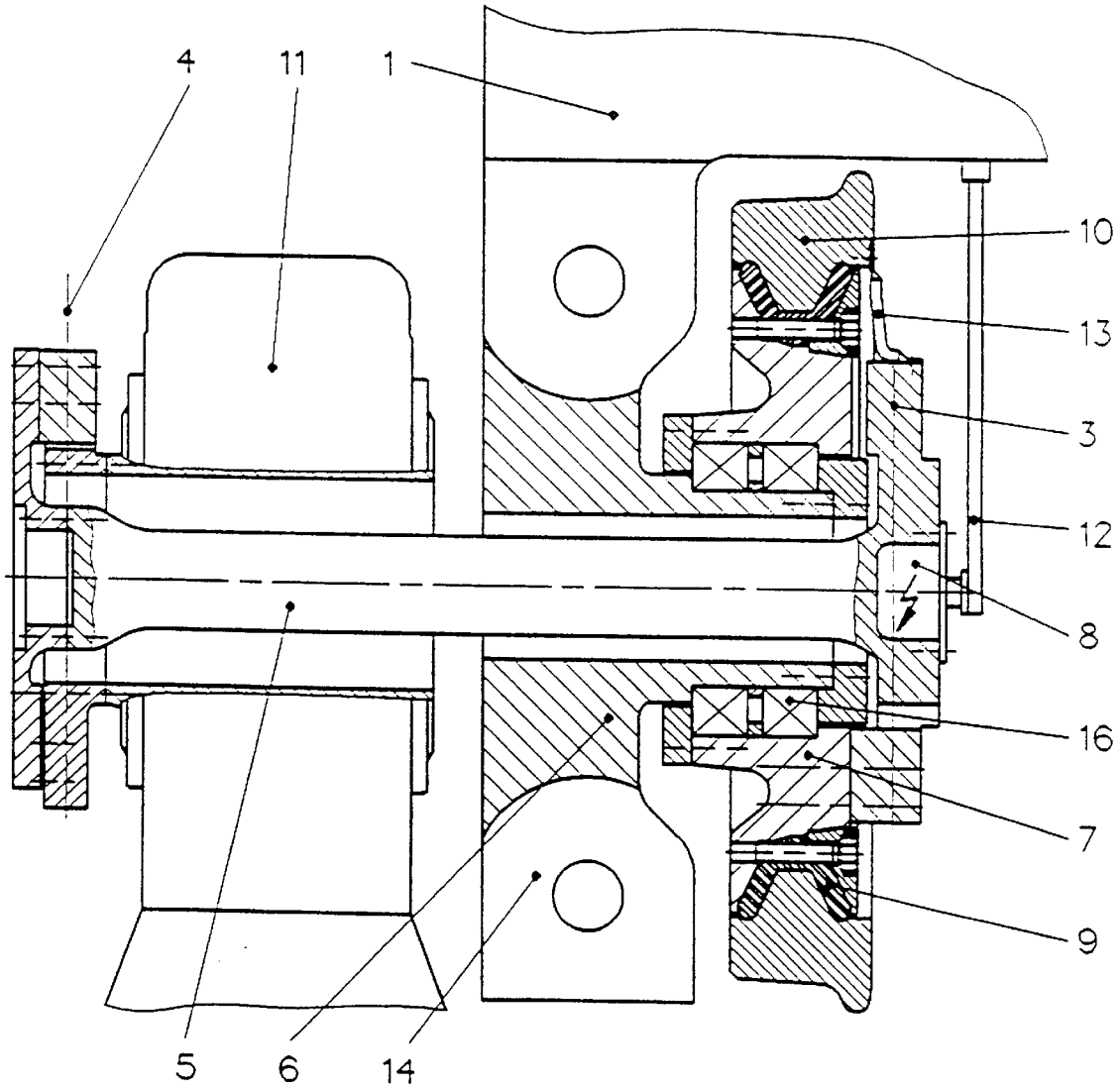
FIG. 2 is partly a horizontal sectional view and partly a top view of the arrangement of the cardanic double coupling as well as the design of the wheel carrier for the rubber-sprung wheel.

Referring to the drawings in particular, the invention comprises an arrangement including a U-shaped wheel-carrying frame 1 (portal axle) of a loose wheel axle surrounding the wheels on the outside. The contact surfaces 14 for the primary spring system are provided at the two legs of the wheel-carrying frame. The driven plane or driven coupling interface 3 of the cardanic double coupling is arranged on the inner side of every individual wheel 2. The plane of the driven coupling interface 3 is a plane which extends substantially at right angles through the axis of rotation of the wheel 2. As shown in FIG. 1, the plane 3 is located on the inner side of the wheels 2. This is the power takeoff or driven coupling interface 3, namely a part of the cardanic double coupling, which transmits the power to the wheels 2. As is shown in FIG. 2, part of the driven coupling plane 3 is arranged directly at the wheel disk 7. The drive plane or drive coupling plane 4 and the driven coupling 3 of the cardanic double coupling are connected to one another via a cardan shaft 5. This cardan shaft 5 is led through an opening of the wheel 2 and of the wheel-carrying frame 1. The drive side 4 is connected via a gear mechanism 11 to the motor, not shown, which is arranged on each side between the wheels 2. The cardanic double coupling is driven by the transmission 11 via the plane 4 or interface 4, such that the plane 4 or interface 4 is the driving plane 4. As is apparent from FIG. 3, the transmission 11, the supports 14 and the wheels 2 are arranged between the planes 3 and 4 of one double coupling. The driving torque is transmitted from the transmission 11 to the coupling in plane 4 in the circumferential direction, and the torque is taken off for driving the wheel 2. Thus the interface or plane 4 forms the input plane of the double coupling and the interface or plane 3 forms the output plane of the double coupling (also drive plane and driven plane).

The drive and driven coupling planes 3, 4 of the cardanic double coupling comprise hollow shaft molettes and wedge assemblies arranged between them in the known manner. The driven gear of the gear mechanism 11 is designed as a hollow shaft. Via the side facing away from the wheel, the drive torque is transmitted to the drive coupling plane 4 of the hollow shaft-wedge assembly coupling via the hollow shaft molette connected to the hollow shaft. A cardan shaft 5 passing through the hollow shaft of the gear mechanism 11 introduces the torque into the driven coupling plane 3. This in turn comprises the same wedge assemblies as those used in the drive coupling 4 and the wheel center connected to the wheel disk 7.

The wheel 2 is mounted on the inner side of the wheel-carrying frame 1 on a hollow axle stub 6 via the wheel bearing 16 directly or by means of a flange connection.

The rotating part of a grounding contact 8 is integrated within the cardan shaft 5. The stationary part is connected to the wheel-carrying frame via a torque support 12, which may also be used as the lead at the same time. The current is sent from the ground contact to the wheel tire 10 via current bridges 13, which are fastened to the coupling molette of the cardan shaft 5.

There is a certain current insulation between the wheel disk and the wheel-carrying frame due to the rubber ring 9 of the rubber-sprung wheel as well as the rubber elements of the driven coupling plane 3 of the cardanic double coupling, so that the installation of current-insulating rolling bearings between the wheel disk 7 and the hollow axle stub 6 may be abandoned.

Figure 3:
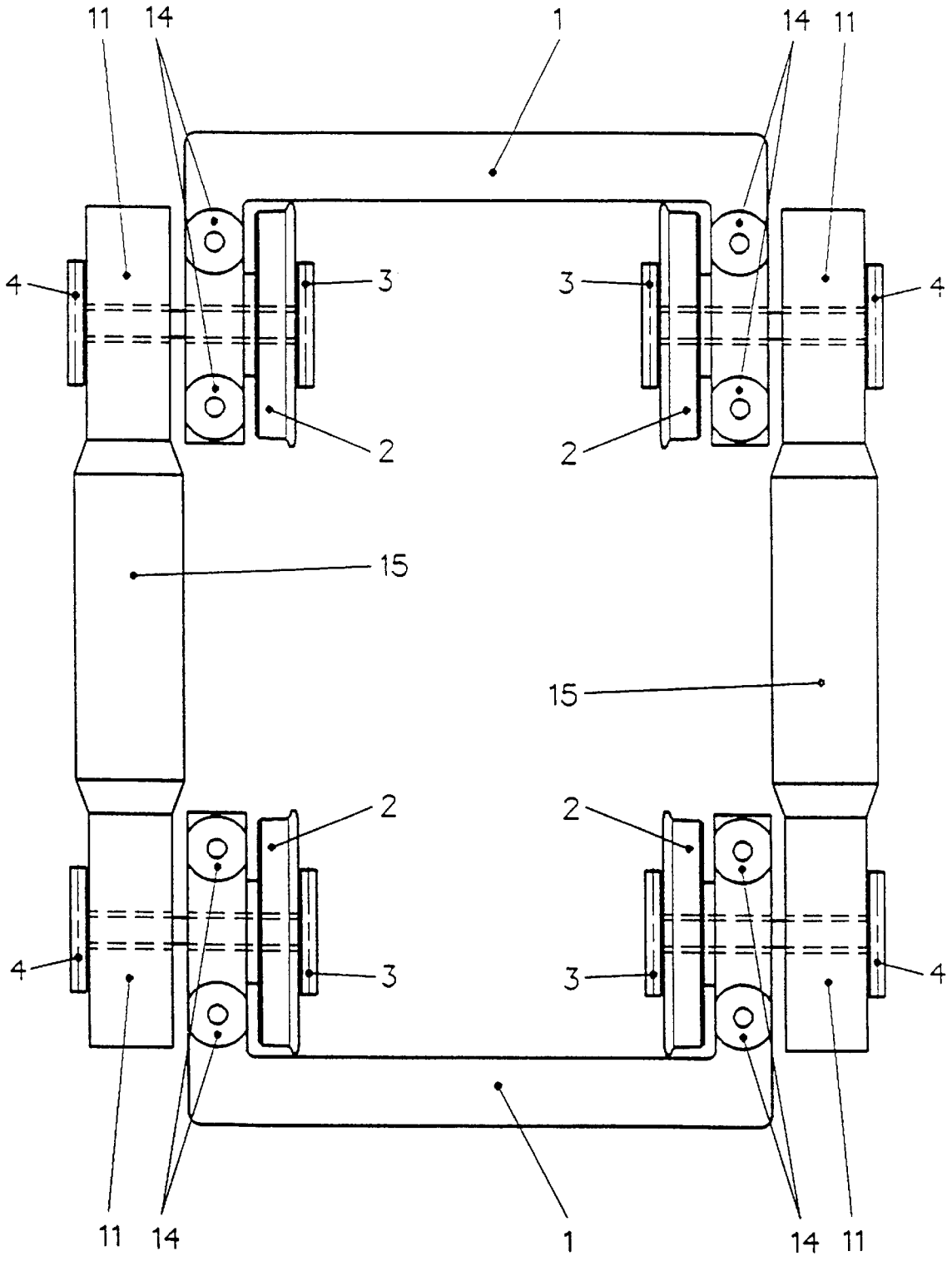
FIG. 3 is schematic top view of the use of the loose wheel axle according to the present invention in a double-axle chassis for a low-platform car.

FIG. 3 shows as an example the use of two loose wheel axles according to the present invention in a driven double-axle chassis. There is one drive unit, which comprises a motor 15 and the bevel gear pairs 11 flanged on both sides, for each longitudinal side of the chassis. The drive unit is suspended on a chassis frame, not shown, which in turn is supported on the wheel-carrying frame 1 of the two loose wheel axles via the primary spring contact surfaces 14.

While a specific embodiment of the invention has been shown and described in detail to illustrate the application of the principles of the invention, it will be understood that the invention may be embodied otherwise without departing from such principles.

What is claimed is:

1. A driven loose wheel axle arrangement with individually mounted wheels on a chassis frame vehicle, the arrangement comprising:

a drive fastened to the chassis frame on an outside on each longitudinal side of the vehicle;

a cardanic double coupling for connecting the drive to one of the individually mounted loose wheels, said cardanic double coupling including a cardan shaft;

a wheel-carrying frame with contact surfaces for a primary spring system, said wheel-carrying frame surrounding two said wheels from an outside;

a driven coupling plane of said cardanic double coupling arranged on an inner side of said one of the individually mounted loose wheels and a drive coupling plane of said cardanic double coupling arranged outside said wheel-carrying frame, said cardan shaft providing a connection between said drive coupling plane and said driven coupling plane and extending through a central opening of said one of the individually mounted loose wheels and extending through an opening of the said wheel-carrying frame.

2. The driven loose wheel axle arrangement in accordance with claim 1, wherein said one of the individually mounted loose wheels is mounted on an inner side of said wheel-carrying frame on a hollow axle stub.

3. The driven loose wheel axle arrangement in accordance with claim 1, wherein said one of the individually mounted loose wheels is directly mounted on an inner side of said wheel-carrying frame on a hollow axle stub.

4. The driven loose wheel axle arrangement in accordance with claim 1, wherein said one of the individually mounted loose wheels is mounted on an inner side of said wheel-carrying frame on a hollow axle stub by means of a flange connection.

5. The driven loose wheel axle arrangement in accordance with claim 1, wherein said one of the individually mounted loose wheels includes a wheel disk as part of a driven coupling of the cardanic double coupling.

6. The driven loose wheel axle arrangement in accordance with claim 1, wherein said one of the individually mounted loose wheels includes a wheel disk and a wheel tire and said arrangement further comprising:

a ground contact integrated within said cardan shaft, said ground contact being connected to said wheel-carrying frame via a torque support;

current bridges leading from a cardan shaft-side coupling molette of said driven coupling plane to said wheel tire; and rubber elements of said driven coupling plane and a rubber ring of said wheel for ensuring current insulation.

7. A driven loose wheel axle arrangement, comprising:

a wheel-carrying frame with contact surfaces for a primary spring system;

individually mounted wheels for a single-axle or double-axle chassis for a rail-borne vehicle, said wheel-carrying frame surrounding two of said wheels from an outside;

a drive fastened to the chassis frame on an outside on each longitudinal side of the vehicle;

a cardanic double coupling for connecting said drive to one of said individually mounted wheels, said cardanic double coupling including a cardan shaft and a driven interface arranged on an inner side of one of said wheels and a drive interface arranged outside said wheel-carrying frame, said cardan shaft providing a connection between said drive interface and said driven interface and extending through a central opening of said one of said wheels and extending through an opening of said wheel-carrying frame.

8. The driven loose wheel axle arrangement in accordance with claim 7, wherein said one of said wheels is mounted on an inner side of said wheel-carrying frame on a hollow axle stub.

9. The driven loose wheel axle arrangement in accordance with claim 7, wherein said one of said wheels is directly mounted on an inner side of said wheel-carrying frame on a hollow axle stub.

10. The driven loose wheel axle arrangement in accordance with claim 7, wherein said one of said wheels is mounted on an inner side of said wheel-carrying frame on a hollow axle stub by means of a flange connection.

11. The driven loose wheel axle arrangement in accordance with claim 7, wherein said one of said wheels includes a wheel disk as part of a driven coupling of the cardanic double coupling.

12. The driven loose wheel axle arrangement in accordance with claim 7, wherein said one of said wheels includes a wheel disk and a wheel tire and said arrangement further comprising:

a ground contact integrated within said cardan shaft, said ground contact being connected to said wheel-carrying frame via a torque support;

current bridges leading from a cardan shaft-side interface element of said driven interface to said wheel tire; and rubber elements of said driven coupling and a rubber ring of said wheel for ensuring current insulation.

* * * * *